US009082256B2

(12) United States Patent
Griswold et al.

(10) Patent No.: US 9,082,256 B2
(45) Date of Patent: Jul. 14, 2015

(54) BACKLIGHT FOR VIDEO DISPLAY

(75) Inventors: Chauncey W. Griswold, Reno, NV (US); Gregory A. Silva, Reno, NV (US); Matthew A. Franich, Reno, NV (US); James Stephen Emslie, Reno, NV (US)

(73) Assignee: IGT, Las Vegas, NV (US)

( * ) Notice: Subject to any disclaimer, the term of this patent is extended or adjusted under 35 U.S.C. 154(b) by 52 days.

(21) Appl. No.: 13/449,168

(22) Filed: Apr. 17, 2012

(65) Prior Publication Data

US 2013/0273992 A1 Oct. 17, 2013

(51) Int. Cl.
*A63F 9/24* (2006.01)
*G07F 17/32* (2006.01)

(52) U.S. Cl.
CPC ..... *G07F 17/3211* (2013.01); *Y10T 29/49826* (2013.01)

(58) Field of Classification Search
CPC ..... G07F 17/3211; G07F 17/34; A63F 2009/2457; G02B 6/0028; G02B 6/0076; G02B 6/0018; G02B 6/002; G02B 6/0043
USPC ..... 463/16–20, 31
See application file for complete search history.

(56) References Cited

U.S. PATENT DOCUMENTS

| | | | | |
|---|---|---|---|---|
| 7,594,852 | B2 | 9/2009 | Rasmussen | |
| 2003/0064799 | A1* | 4/2003 | Goins et al. | 463/30 |
| 2004/0147303 | A1* | 7/2004 | Imura et al. | 463/16 |
| 2004/0224758 | A1* | 11/2004 | Okada et al. | 463/31 |
| 2005/0024555 | A1 | 2/2005 | Shiraishi et al. | |
| 2005/0282617 | A1* | 12/2005 | Sekiguchi et al. | 463/20 |
| 2008/0096655 | A1* | 4/2008 | Rasmussen et al. | 463/31 |
| 2008/0207303 | A1* | 8/2008 | Rasmussen | 463/20 |
| 2009/0131145 | A1 | 5/2009 | Aoki et al. | |
| 2009/0262552 | A1 | 10/2009 | Kamikatano et al. | |
| 2010/0048288 | A1 | 2/2010 | Canterbury et al. | |
| 2010/0190552 | A1 | 7/2010 | Rasmussen et al. | |
| 2011/0085109 | A1* | 4/2011 | Kim | 349/62 |
| 2011/0124411 | A1* | 5/2011 | Tanimura et al. | 463/31 |

OTHER PUBLICATIONS

Search report for EP Application No. 13 16 3883, mail date Aug. 6, 2013, 8 pages.

* cited by examiner

*Primary Examiner* — Steve Rowland
(74) *Attorney, Agent, or Firm* — Neal, Gerber & Eisenberg LLP

(57) ABSTRACT

A gaming system including an electronic gaming machine (EGM) having a backlit video display, is described. In particular, the EGM can be configured with a display that allows display elements, such as mechanical stepper reels, positioned behind the display to be either revealed or obscured by using directional lighting. The display assembly can include an edge-lit light guide having different regions that can extract light coming from a particular direction.

18 Claims, 10 Drawing Sheets

BACKLIGHT FOR VIDEO DISPLAY

BACKGROUND

1. Field of the Described Embodiments

The described embodiments relate generally to gaming systems, such as gaming systems deployed in a casino enterprise. More particularly, apparatuses and methods for illuminating a display on an electronic gaming machine (EGM) are described.

2. Description of the Related Art

Liquid crystal displays (LCD) used in EGMs typically have specially modified backlights that have the center region removed in order to create an opening through which to view mechanical rotatable stepper reels positioned behind the LCD. During game play of a wager-based game on an EGM, the mechanical stepper reels typically spin in response to a wager. The reels then stop spinning to produce an outcome selected by a processor within the EGM. A video display around the mechanical reels can not only enhance the display and provide additional information but also interact with the mechanical reels.

An adverse consequence of removing the backlight to reveal the mechanical reels is that removal of the backlight results in insufficient light to effectively illuminate images on the LCD adjacent the removed portion of the backlight in the center region. The opening through which the stepper reels can be viewed also causes the reels to remain visible at all times, thereby compromising and limiting the graphical content of the display on the EGM.

The popularity of video displays in combination with mechanical reels on EGMs allows for the possibility of displaying dynamic, vivid and engaging video content to further personalize and enhance the gaming experience in a casino gaming environment. In view of the above, methods and apparatuses are desired that allow for enhanced video display capable obscuring and revealing display items positioned behind a video display on an EGM in a casino environment.

SUMMARY OF THE DESCRIBED EMBODIMENTS

A gaming system including EGMs having backlit video displays is described. In particular, the backlit video displays can be controlled using directional lighting. The backlit video display can also reveal or obscure display elements, such as mechanical reels or organic light emitting diodes (OLED) or LCD simulating reels or other items, positioned behind the display. To prevent such items from being seen, an edge-lit light guide can be provided with a substantially transparent portion directly in front of such items that can be lit in a directional manner to obscure such items.

One aspect of the methods and apparatuses described herein is related to an electronic gaming machine. A video display assembly on an electronic gaming machine for a wager-based game can include: a video display; a light guide positioned behind the video display; and a light source. The light guide can include a continuous substrate having a substantially transparent window portion and a surrounding portion around the window portion. The light source can illuminate the window portion, and the light source is positioned along an edge of the light guide. Features are also provided in a viewing surface of the window portion to extract light from the light source.

Another aspect of the methods and apparatuses described herein is related to a method of making a video display assembly in an electronic gaming machine for a wager-based game.

The method can be generally characterized as including: 1) providing a video display; 2) positioning a light guide behind the video display; and 3) positioning a light source along an edge of the light guide. The light guide includes a continuous substrate having a window portion and a surrounding portion around the window portion. The window portion is substantially transparent and has features in a viewing surface. The features in the viewing surface of the window portion are oriented to extract light from the first light source.

Yet another aspect of the methods and apparatuses described herein is related to a method of operating a backlit video display assembly in an electronic gaming machine for a wager-based game. The method can be generally characterized as controlling a light source to reveal or obscure at least one display element behind a window portion of a light guide. The light source is positioned along an edge of the light guide, and the light guide includes a continuous substrate having the window portion and a surrounding portion around the window portion. The window portion is substantially transparent and has features in a viewing surface configured to extract light from the light source.

Another aspect of the methods and apparatuses described herein is related to a video display assembly on an electronic gaming machine for a wager-based game. The video display assembly includes a video display; a first light guide positioned behind the video display that includes a substantially transparent window portion; and a first light source for illuminating the window portion. The first light source is positioned along a first edge of the light guide, and the first light guide includes features in a viewing surface of a window portion to extract light from the first light source.

BRIEF DESCRIPTION OF THE DRAWINGS

The embodiments will be readily understood by the following detailed description in conjunction with the accompanying drawings, wherein like reference numerals designate like structural elements, and in which.

DESCRIBED EMBODIMENTS

Figure 1:
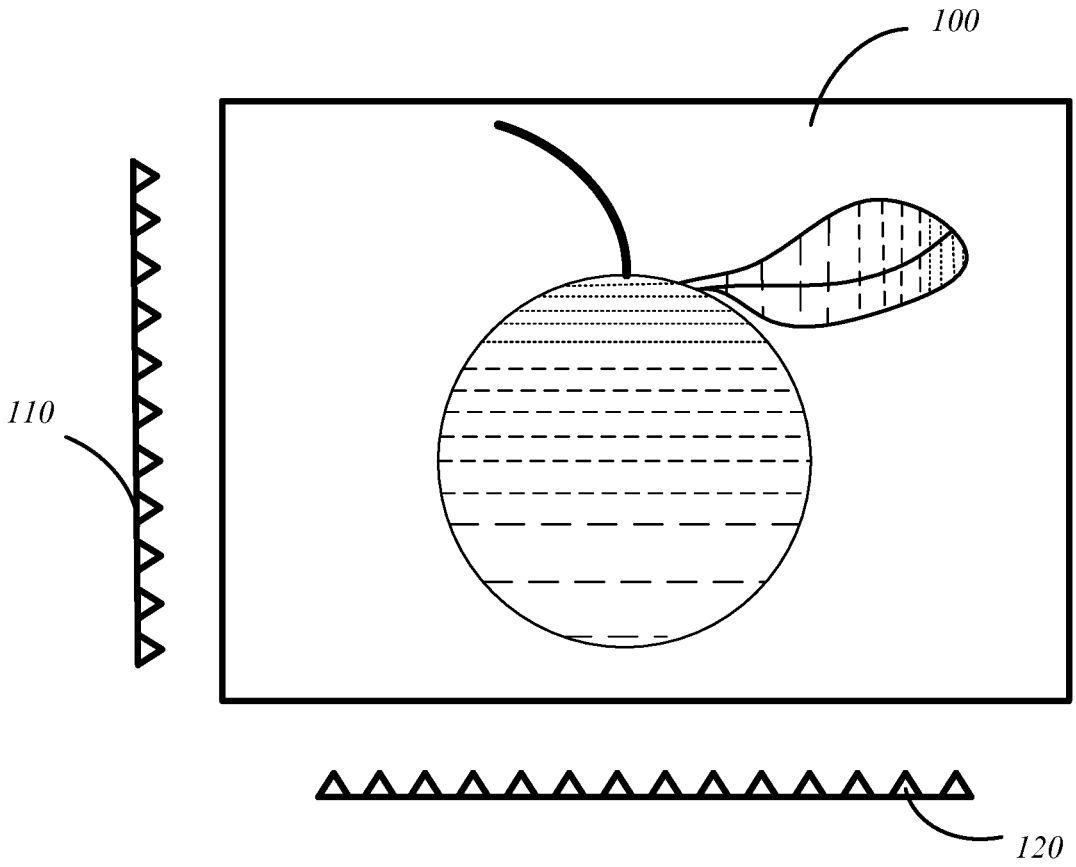
FIG. 1 shows an example of a light guide controlled using directional lighting.

In this paper, numerous specific details are set forth to provide a thorough understanding of the concepts underlying the described embodiments. It will be apparent, however, to one skilled in the art that the described embodiments may be practiced without some or all of these specific details. In other instances, well known process steps have not been described in detail in order to avoid unnecessarily obscuring the underlying concepts.

A wager-based gaming system that can include an EGM with a backlit video display is described. Typically, a key component in LCD backlights is an edge-lit light guide. The light guide is typically an acrylic plate. Light from a light source is first directed or injected into the edge of the light-guide. The light remains trapped within the acrylic so long as the top and bottom surfaces of the acrylic plate are parallel and mirror-like. This phenomenon is known as Total Internal Reflection. The reflecting light remains within the light guide until it encounters a disruption in the smooth surface allowing it to exit the light guide. A disruption in the surface can refract the light trapped within the guide and redirect the light out of the light guide and into the atmosphere. This phenomenon is known as light extraction. Printing, molding or engraving the face of the light guide can disrupt its smooth reflective surface, thereby extracting light from the light guide. Other suitable materials for a light guide include, for example, polycarbonate, epoxies, and glass.

In particular embodiments, electronic gaming machines (EGMs) used in a gaming environment can include backlit video displays that can be controlled using directional lighting. The video displays can also reveal reels or another display element located behind the video displays. The video display can be the secondary display element with the other display element behind the video display being the primary display element or the display element behind the video display can be the secondary display element with the video display being the primary display element. An example of a display using directional lighting is described with respect to FIG. 1. Details of a light guide controlled by directional lighting are described with respect to FIGS. 2A-4. With respect to FIG. 5, examples of features in a viewing surface of a light guide and the resulting images produced are described. With respect to FIG. 6, a method for making an embodiment of a backlit video display for an EGM is described. With respect to FIG. 7, a method of operating an embodiment of a backlit video display for an EGM is described. Finally, additional details of a game controller and an EGM are described with respect to FIGS. 8 and 9.

Different types of light guides can be used for different purposes. Typically, a light guide is positioned behind the LCD as a backlight. For example, one type of light guide is a LCD light guide, which is a substantially opaque luminaire designed to extract light uniformly for LCDs. Another type of light guide is a signage light guide, which is typically a substantially transparent sign engraved to illuminate text, shapes or graphics. These light guides appear mostly transparent, using bright contrasting light to create graphics against a transparent background.

FIG. 1 shows an example of a light guide 100 used for multi-colored signage. Typically, the multi-colored signage light guides are transparent light-guide signs that extract light depending on the specific direction from which the light is injected. FIG. 1 shows an example of a light guide for a decorative sign developed by OMRON™ Corporation. The decorative sign shown in FIG. 1 can feature a red cherry with green leaves. In the illustrated example, the cherry can be rendered with red light injected from a light source 120 positioned along the bottom edge of the light guide 100. Similarly, the green leaves can be rendered with the green light injected from the side light source 110 positioned along the side edge of the light guide 100, as shown in FIG. 1.

The engraving on the surface of the light guide 100 of the cherries and leaves can be carefully oriented to refract only light traveling from the bottom or the side, respectively. As shown in FIG. 1, the cherry portion is engraved or etched with features, such as, for example, marks, notches, and nanoparticles, that are oriented in a substantially horizontal direction to extract the red light injected into the light guide 100 from the light source 120 along the bottom edge of the light guide 100. The leaf portion is engrave or etched with features that are oriented in a substantially vertical direction to extract the green light injected into the light guide 100 from the light source 110 along the right side edge of the light guide, as illustrated in FIG. 1.

Figure 2A:
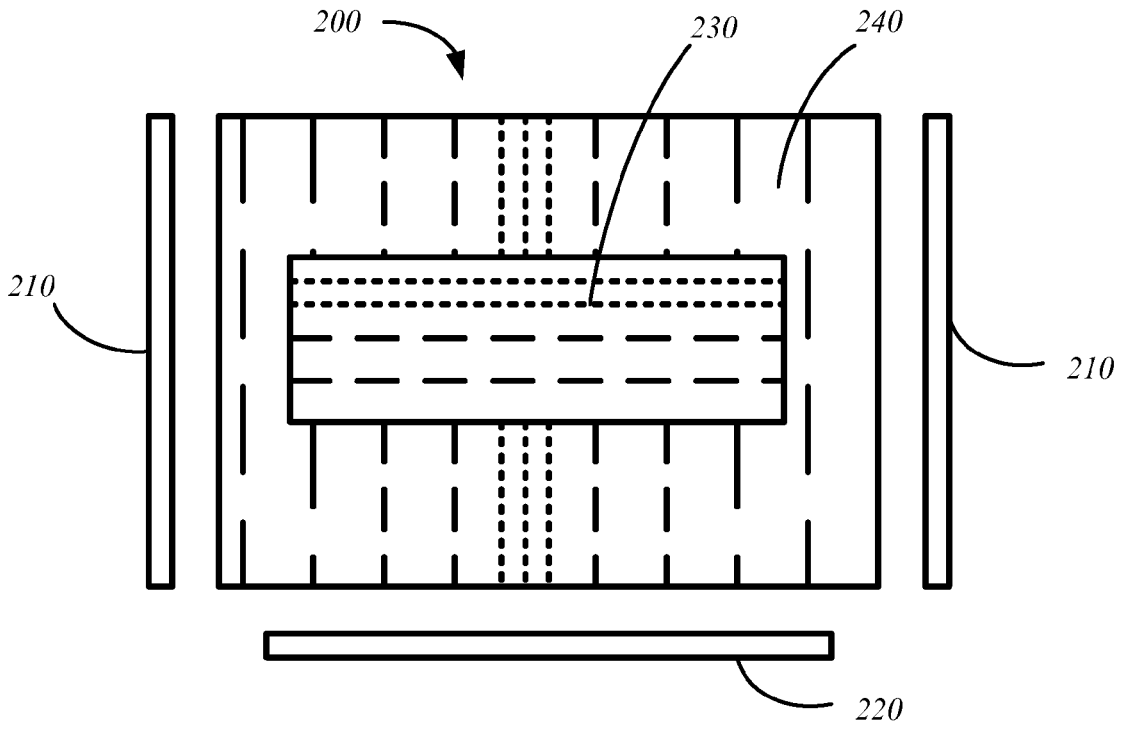
FIG. 2A shows a front view of a light guide and light sources with mechanical reels obscured in accordance with an embodiment.
Figure 2B:
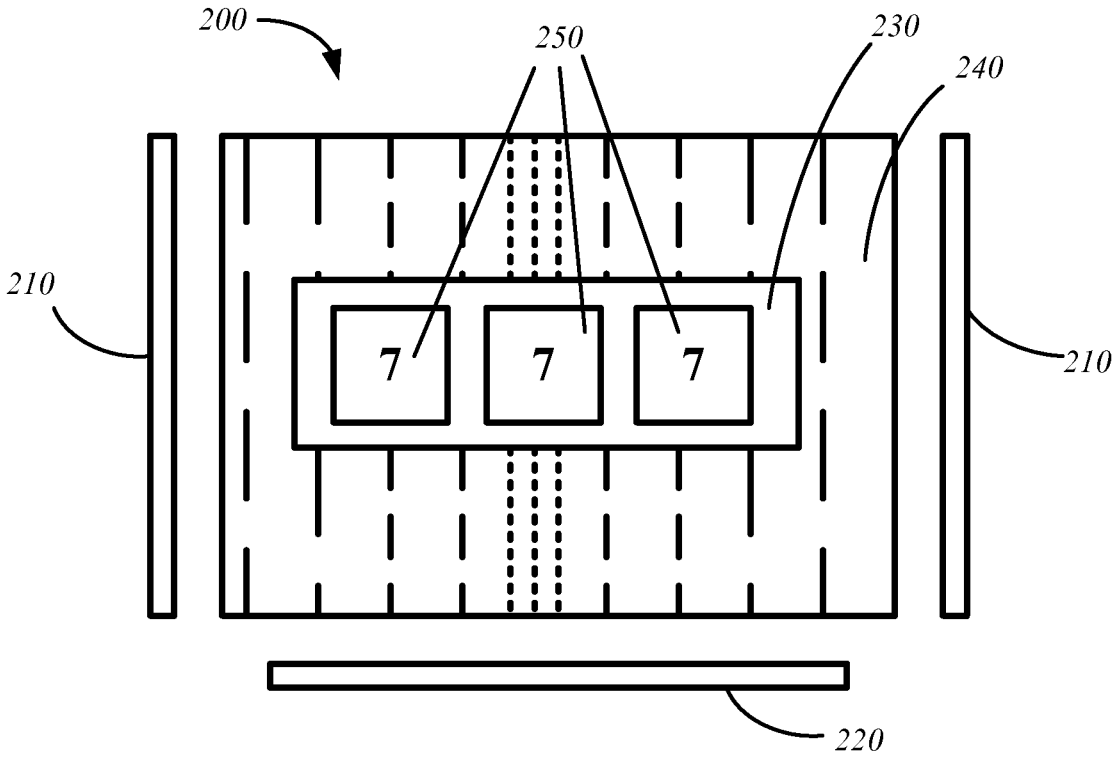
FIG. 2B shows a front view of a light guide and light sources with mechanical reels revealed in accordance with an embodiment.

According to an embodiment, a display for an EGM can include one or more of the three different types of light guides described above. Unlike traditional backlit transmissive displays for EGMs that have a cut-out opening in the light guide to reveal mechanical reels behind the light guide, an embodiment, as illustrated in FIGS. 2A-2B, has an edge-lit light guide 200 that does not have any cut-outs for revealing the mechanical reels 250 positioned behind the light guide 200. Instead, according to this embodiment, the light guide 200 is a continuous substrate that includes a substantially transparent window portion 230 and a surrounding portion 240 that can be substantially opaque. In an alternative embodiment, both the window portion 230 and the surrounding portion 240 can be substantially transparent and can be selectively controlled to be transparent or opaque using directional lighting similar to the cherry design shown in FIG. 1. For example, according to an embodiment, the transparency of the window 230 can be controlled using directional lighting similar to the cherry design shown in FIG. 1. The remaining portion 240 can also be similarly controlled. As shown in FIGS. 2A and 2B, the light guide 200 can have a substantially transparent window portion 230 and a surrounding portion 240 around the window portion 230. Particular regions of the light guide 200 can be illuminated depending on the direction of the light source 210, 220. In some embodiments, the surrounding portion 240 may be illuminated to obscure mechanical hardware or some other display element behind the video display. In other embodiments, the surrounding portion 240 can be dimmed or off and can obscure the mechanical hardware behind the display if the surrounding portion is substantially opaque. It will be understood that all or a portion of the surrounding portion 240 can be illuminated.

Although a single window portion 230 is shown in the illustrated embodiment, it will be understood that the light guide 200 can include more than one window portion 230. According to such an embodiment, individual window portions 230 can be illuminated, either together with or separately from other window portions 230. For example, the illumination of each window portion 230 can be individually controlled. As an example, turning on or off light sources illuminating the window portions 230 in a sequence can create a fading effect within the window portions. Alternatively, the illumination for two or more window portions 230 can be controlled together.

The window portion 230 can also have a transparent mode when the display in the window portion 230 is turned off and an opaque mode when the display in the window portion 230 is turned on. When the display in the window portion 230 is turned on, the light extracted by the light guide 200 in the window portion 230 can be bright enough such that the stepper reels 250 are obscured. The window portion 230 can be turned on by turning on the light source(s) that illuminate the window portion 230. The display in the window portion 230 can be made as bright as possible so that the "window" cannot be detected easily relative to the rest of the display surrounding the window portion 230. Brightness enhancing films and shutters can also be used to enhance brightness or provide additional opacity.

When light is extracted and made as bright as possible in the window portion such that the light in the window portion 230 is turned on, the portion of the LCD 260 (FIGS. 3 and 4) in front of the window portion 230 of the light guide 200 can be continuous with the rest of the LCD 260 such that the display is seamless and appear as a single image, and the window portion 230 cannot be detected. Alternatively, the portion of the LCD 260 in front of the window portion 230 of the light guide 200 can display content that is different from the rest of the LCD 260 such that the window portion 230 can be detected but the image displayed on the LCD 260 in front of the window portion 230 can be so bright that the mechanical reels 250 are obscured. Thus, the EGM is capable of providing a display combining video and mechanical reels 250, solely video, or solely mechanical reels (by turning off all of the video displays or by completely turning on all of the displays in the case of WVA LCD technology). It will be understood that although the display assembly is described as including a LCD, it will be understood that other types of video displays, such as, for example, OLED displays, can also be included. Similarly, although the illustrated embodiments show mechanical reels 250 that can be obscured or revealed by the display assembly, it will be understood that other display elements can be obscured or revealed behind the window portion 230. For example, such display elements can include simulated reels, other video elements, as well as mechanical elements.

The rest of the display can be used for any suitable purpose. For example, the remaining portion 240 of the display can display a bonus game, display advertisement, display instructions, enhance the outcome of the mechanical reels 250 or some other display element, and/or display animation.

Micro-etching the window 230 portion of the light guide 200 can allow extraction of light from the light source 220 entering from the top and/or bottom edges of the light-guide 200 so the display functions as a traditional LCD. As noted above, this display can be bright enough such that it obscures the stepper reels 250 positioned behind it. According to the embodiment shown in FIGS. 2A-2B, the viewing surface of the window 230 portion can be micro-etched with features such that the window 230 portion extracts light from the bottom light source 220.

In the illustrated embodiment, when the bottom light source 220 is turned off, as shown in FIG. 2B, the window 230 becomes transparent or substantially transparent, and the mechanical reels 250 behind the window 230 become visible to the player. In this embodiment, when the bottom light source 220 is turned off, the display in the window 230 is also turned off. With the display in the window 230 off, the mechanical reels 250 behind the window 230 are no longer obscured by a display in the window 230, and can be seen through the window 230 because the window 230 is transparent or substantially transparent. In the embodiment shown in FIGS. 2A-2B, the area 240 of the light guide 200 surrounding the window 230 can be opaque and micro-etched such that it extracts light from the right and left sides from side light source(s) 210.

To obscure the mechanical reels 250, the window 230 portion can be made more opaque by turning on the display in the window 230. The brighter the display in the window 230, the more opaque the window 230 becomes, thereby obscuring the mechanical reels 250 behind the window 230.

In an embodiment, the light sources 210, 220 can be LED (light emitting diodes) light bars. In other embodiments, the light sources 210, 220 can be, for example, laser diodes, Cold Cathode Fluorescent Lamps (CCFLs), External Electrode Fluorescent Lamps (EEFLs), Hot Cathode Fluorescent Lamps (HCFLs), and/or Electroluminescent lamps. Optical improvement may be seen in collimating the light source to help reduce light extraction cross contamination in the window and surrounding areas.

It will be understood that the light source 210, 220 need only be sized to illuminate the portion it is intended to illuminate. For example, light source 220 can have a length that is at least as long as the length of the window portion 230. As illustrated in FIGS. 2A and 2B, the light source 220 is slightly longer than the length of the window portion 230. However, it will be understood that it can be more cost effective to provide a shorter light source that is the same length as the window portion 230. Similarly, the light sources 210 can be at least the length of the width of the light guide 200 such that the light sources 210 are capable of illuminating the entire portion of the light guide 210 that surrounds that window portion 230.

As shown in the embodiment of FIGS. 2A-2B, the viewing surface of the window portion 230 can be micro-etched with features on the light guide 200 that are oriented in a substantially horizontal direction such that they extract light from the bottom light source 220. It will be understood that although only a bottom light source 220 is shown in FIGS. 2A-2B, the features in the window portion 230 can also extract light from a light source positioned along the top edge of the light guide 200. Thus, the light guide 200 can be provided with a top and/or bottom light source. Similarly, it will be understood that although two side light sources 210 are shown in FIGS. 2A-2B, the features in the light guide 200 surrounding the window portion 230 can also extract light from a single side light source. Two light sources along opposite edges of the light guide 200 (as opposed to a single light source along one edge) may be preferable to avoid the adverse consequence of potential diminished brightness, transparency, or need for high density features. As will be explained in more detail below, the density of the features and their distance from the corresponding light source affect the brightness of the light extracted through those features. In other embodiments, the features in the window portion 230 can also be oriented such that they can extract light from a side light source(s) and the features in the portion surrounding the window portion 230 can be oriented such that they can extract light from a top and/or bottom light source.

Figure 3:
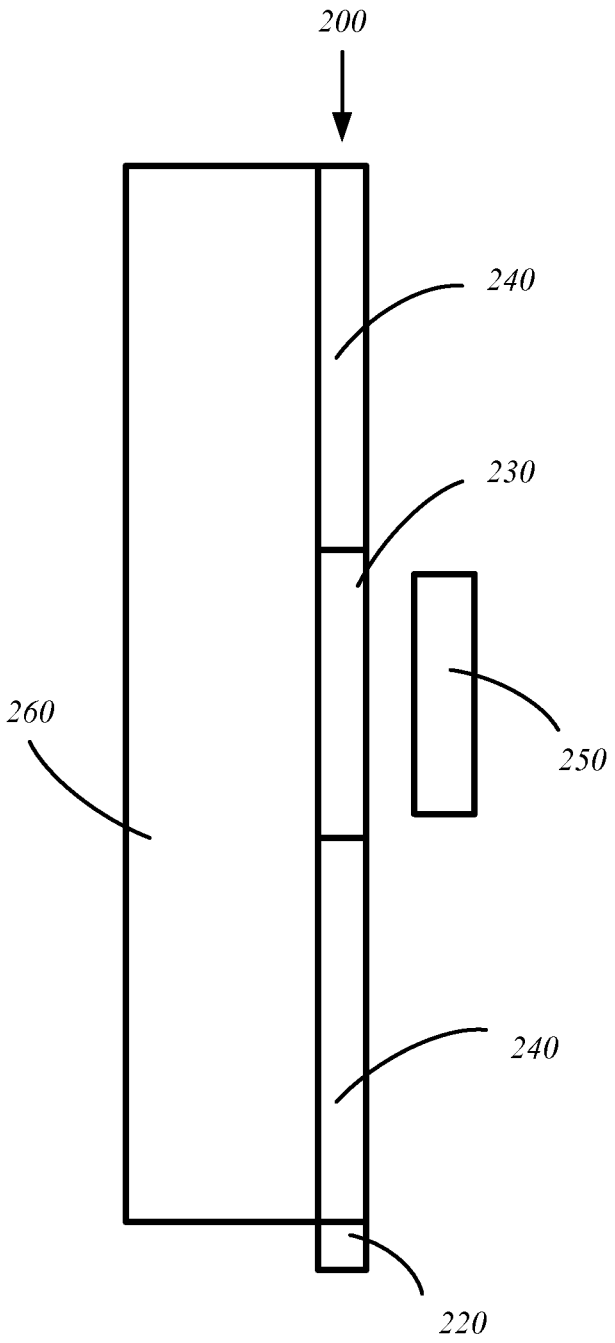
FIG. 3 is a side view of a display assembly in accordance with an embodiment.

FIG. 3 is a cross-sectional side view of a display assembly according to an embodiment. As shown in FIG. 3, a display 260 can be positioned in front of the light guide 200. As shown in FIG. 3, mechanical stepper reels 250 can be positioned behind the window portion 230 of the light guide 200. A light source 220 can be positioned along the bottom edge of the light guide 200. In an alternative embodiment, a light source can be positioned along the top edge of the light guide 200 in addition to or in place of a light source along the bottom edge. It will be understood that, depending on the design, the window portion 230 can be lit from a light source from the top and/or bottom of the light guide, or alternatively from a light source from the side(s) of the light guide. So long as the window portion 230 is lit from a different light source from a different direction as the light source lighting the area of the light guide 200 surrounding the window portion 230, the display of the window portion 230 can be turned on or off to obscure or reveal the mechanical reels 250.

Figure 4:
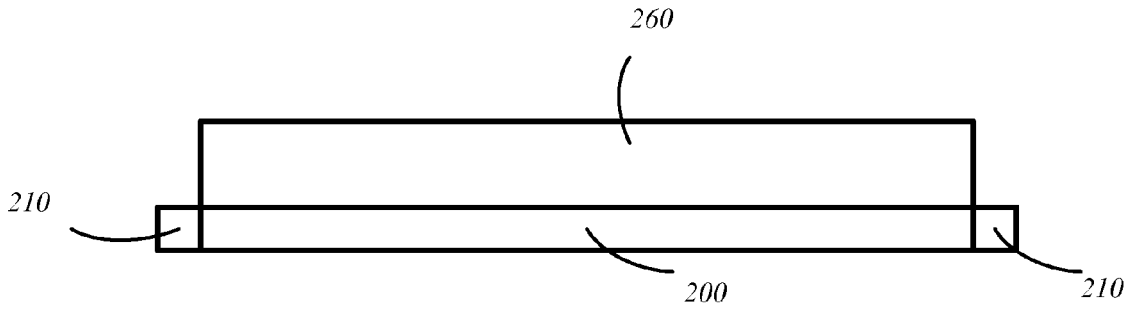
FIG. 4 is a top view of a display assembly in accordance with an embodiment.

FIG. 4 is a top view of the display assembly shown in FIG. 3. As shown in FIG. 4, side light sources 210 can be positioned along the side edges of the light guide 200. Although light sources 210, 220 are shown in FIGS. 2A and 2B to be spaced apart from the light guide 200, it will be understood that the light sources 210, 220 can be positioned along an edge of the light guide 200 such that the light source 210, 220 are directly adjacent the light guide 200 (as shown in FIG. 3).

Although a single light guide 200 including features in a window portion and a surrounding portion, it will be understood that the display assembly can include more than one light guide. For example, one light guide can include features in a window portion configured to extract light from a light source along one edge. A second light guide, which can be positioned directly in front of or behind the first light guide, can also be included with features in a surrounding portion configured to extract light from a light source along an edge that is substantially perpendicular to the other light source. These light sources can be controlled together or individually. Additional light guides with features in yet another window portion or other portions of the surrounding area can also be provided. The light guides can be attached to one another. For example, the light guides can be stacked on top of one another and bonded together using an adhesive, such as optically clear adhesive.

Figure 5A:
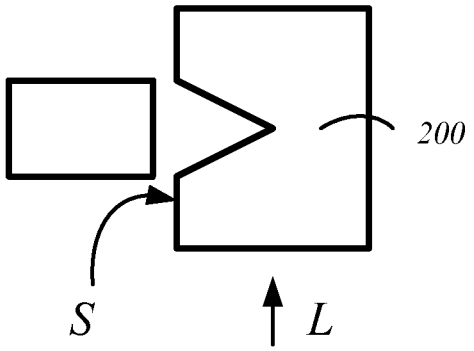
FIGS. 5A-5C show examples of features in a viewing surface of a light guide and resulting images produced.
Figure 5B:
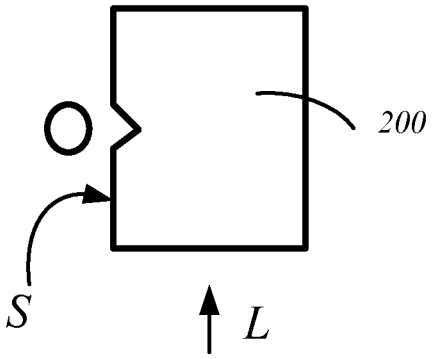
Figure 5C:
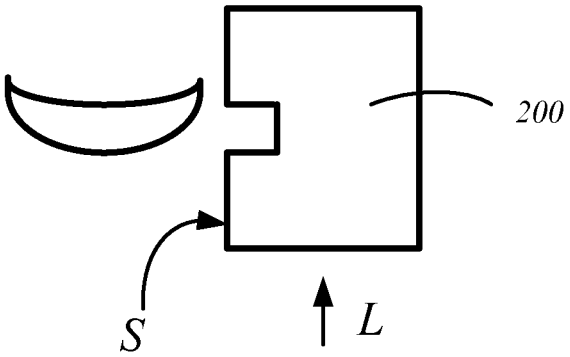

FIGS. 5A-5C show cross-sectional views of exemplary shapes of features that can be etched on the viewing surface S of the light guide 200 and the corresponding shapes of images that the features can produce on the display by extracting light coming from the direction of arrow L. For example, in FIG. 5A, a deep V-shaped feature that is etched into the viewing surface S of a light guide 200 can produce a substantially square shaped image. As shown in FIG. 5B, a more shallow V-shaped feature etched into the viewing surface S of the light guide can produce a generally circular image. FIG. 5C shows that a substantially rectangular feature can produce a crescent shaped image. It will be understood that features of different shapes can produce corresponding images of different shapes. The shape, density, and depth of the features can affect the brightness and the shape of the images produced. Generally, the deeper the feature, the brighter the image displayed because there is more light extraction although it may result in diminished transparency.

As shown in FIGS. 2A and 2B, in order to provide a more uniform brightness throughout the entire light guide 200, the density of the features in the light guide 200 is lower closer to the light source 210 and 220 and the density of the features become higher farther away from the light sources 210 and 220. It will be understood that the closer a feature is to a light source, the more light will be extracted by the feature and the brighter the image displayed. Thus, to avoid undesired variations in brightness across the light guide 200, the density of the features can be adjusted as described above to prevent the portions of the light guide 200 closer to the light source from being noticeably brighter than portions farther away. Providing light sources along opposite edges of the light guide can also help with brightness uniformity as well as improve transparency when the light sources are off because fewer features would be required on the light guide 200.

Due to variations in the precision of creating the features, or due to the light emitted from the light sources not being perfectly directional, there may be some small amount of light leakage which inadvertently emanates from the directional features having planar surfaces parallel to the general direction of the light intended to illuminate the directional features in the other region which have planar surfaces which are perpendicular to the general direction of the light. To overcome such a problem, according to an alternative embodiment, two light guides can be positioned with one behind the other. Each of the light guides can have a different non-etched transparent region and an etched backlight region. In this alternative embodiment, the features would not even need to be directional. While this embodiment solves the leakage light problem, it may result in increased cost and perhaps an imperfect overlap of the etched regions from the viewing perspective of the patron. Alternatively, the features can be created by laser etching, chemical etching, mechanical etching, patterned resin calendared onto the surface, injection molding, or printing the features on the surface.

Figure 6:
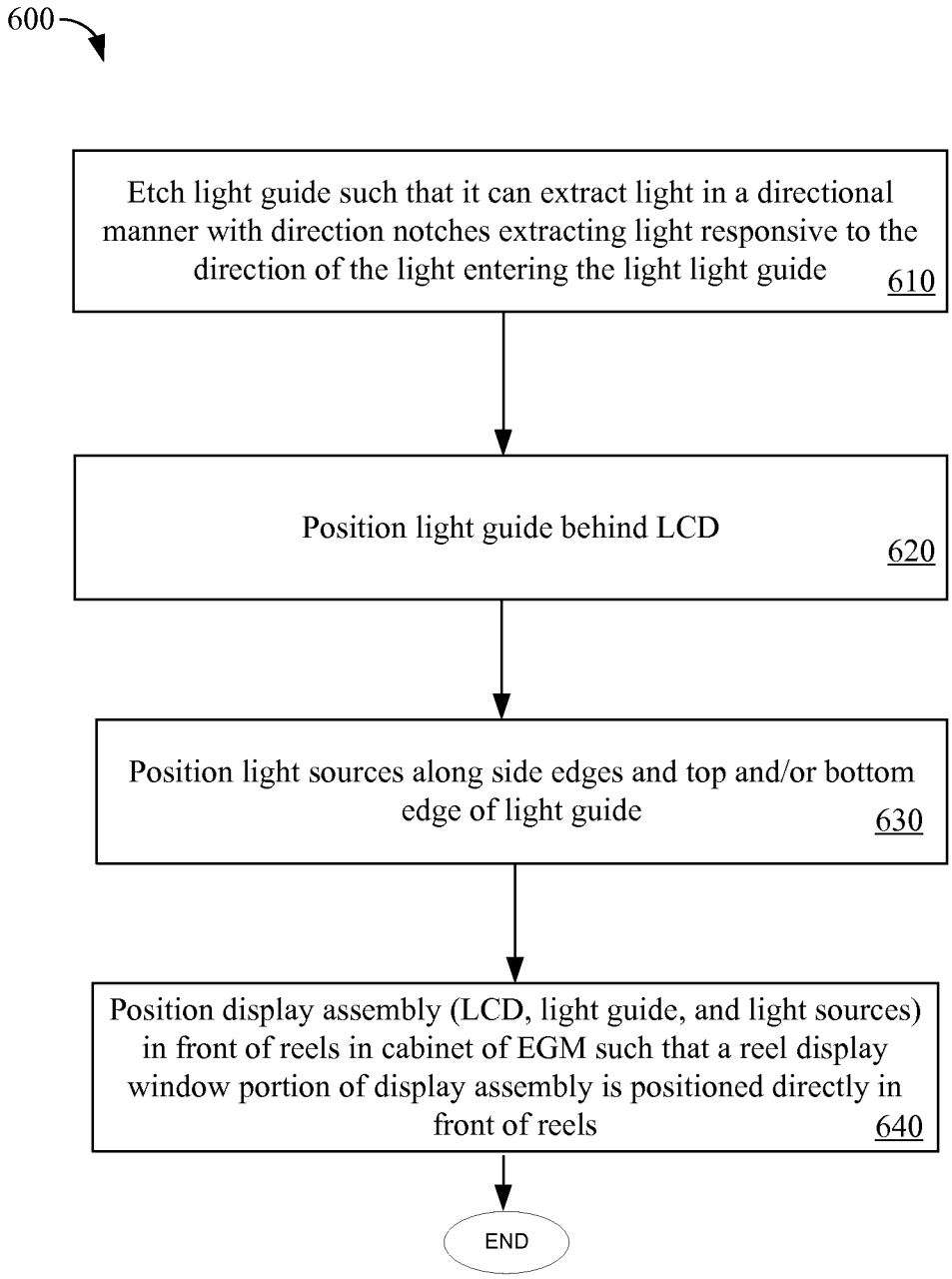
FIG. 6 is a flow diagram of a method for making a video display device for an EGM according to an embodiment.

FIG. 6 is a flow chart of a method 600 for making a video display device for an EGM according to an embodiment. Steps 610-630 describe making a display assembly in this embodiment. The display assembly can include a LCD in front of a light guide having a window portion that is substantially transparent when that portion of the display is turned off. In 610, the light guide is etched such that it can extract light in a directional manner. The features are etched such that the features are responsive to the direction of light entering the light guide from substantially different orthogonal directions. In some embodiments, the features in one region (e.g., a window portion) can be etched to extract light from one direction, and features in another region (e.g., a surrounding portion) can be etched to extract light from a substantially orthogonal direction. After it is etched, the light guide is positioned behind a LCD in 620. In 630, light sources are positioned along side edges of the light guide and along a top or bottom edge of the light guide. In 640, the display assembly is positioned in front of the stepper reels in a cabinet of the EGM such that the reel display window portion of the display assembly is positioned directly in front of the stepper reels.

Figure 7:
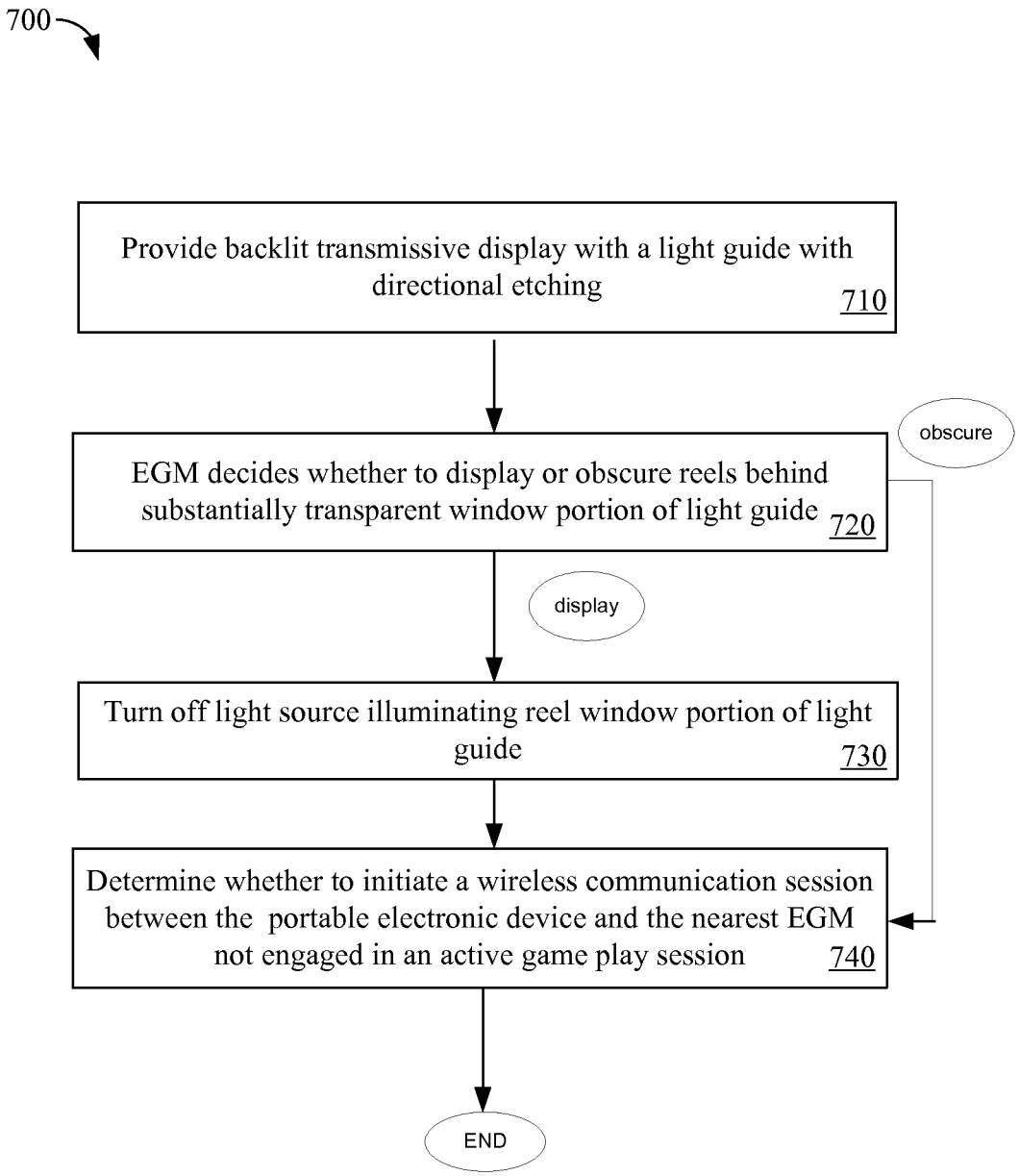
FIG. 7 is a flow diagram of a method of operating a video display device of an EGM according to an embodiment.

FIG. 7 is a flow chart of a method 700 of operating a video display device of an EGM according to an embodiment. In 710, an EGM having a backlit video display device with a light guide is provided. The light guide in this embodiment is provided with directional etching such that the light guide extracts light through the etching based on the direction from which the light shines. In 720, the EGM decides whether to display or obscure stepper reels positioned directly behind a substantially transparent window portion of the light guide. If the EGM decides to display the stepper reels, the light source illuminating the window portion of the light guide is turned off in 730. If the EGM decides to obscure the stepper reels, the light source illuminating the window portion of the light guide is turned on in 740.

Figure 8:
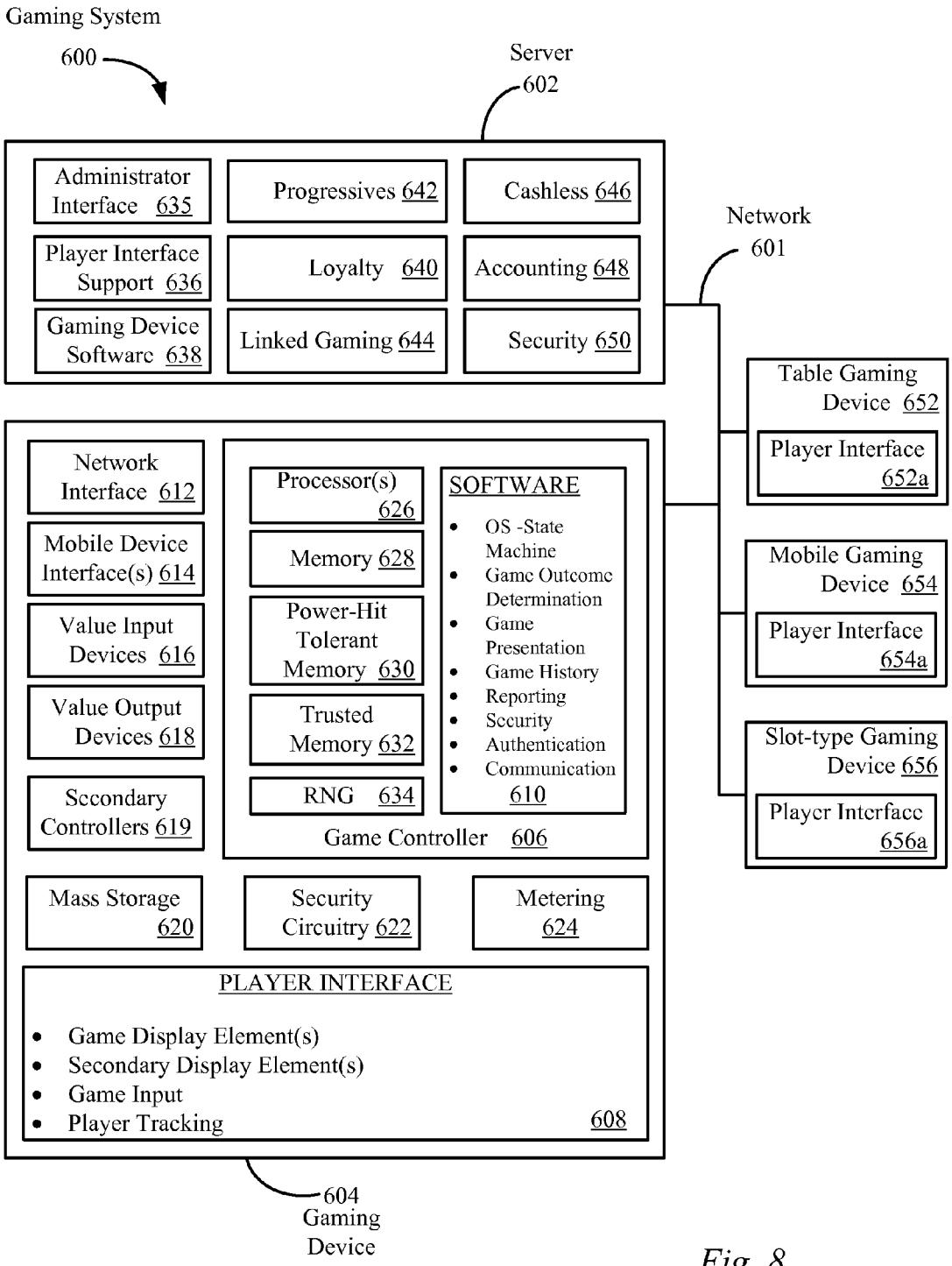
FIG. 8 shows a block diagram of a gaming system including a server and gaming devices in accordance with the described embodiments.

FIG. 8 shows a block diagram of a gaming system 600 in accordance with the described embodiments. The gaming system 600 can include one or more servers, such as server 602, and a variety of gaming devices including but not limited to table gaming devices, such as 652, mobile gaming devices, such as 654, and slot-type gaming devices, such as 656. The table gaming devices, such as 652, can include apparatus associated with table games where a live operator or a virtual operator is employed. The gaming devices and one or more servers can communicate with one another via a network 601. The network can include wired, wireless or a combination of wired and wireless communication connections and associated communication routers.

Some gaming devices, such as 652, 654 and 656, can be configured with a player interface that allows at least 1) selections, such as a wager amount, associated with a wager-based game to be made and 2) an outcome of the wager-based game to be displayed. As an example, gaming devices, 652, 654 and 656, include player interfaces, 652*a*, 654*a* and 656*a*, respectively. Typically, gaming devices with a player interface are located in publicly accessible areas, such as a casino floor. On the other hand, some gaming devices, such as server 602, can be located in publicly inaccessible areas, such is in a back-room of a casino or even off-site from the casino. Gaming devices located in publicly inaccessible areas may not include a player interface. For instance, server 602 does not include a player interface. However, server 602 includes an administrator interface 635 that allows functions associated with the server 602 to be adjusted.

An example configuration of a gaming device is described with respect to gaming device 604. The gaming device 604 can include 1) a game controller 606 for controlling a wager-based game played on the gaming device and 2) a player interface 608 for receiving inputs associated with the wager-based game and for displaying an outcome to the wager-based game. In more detail, the game controller 606 can include a) one or more processors, such as 626, b) memory for holding software executed by the one or more processors, such as 628, c) a power-hit tolerant memory, such as 630, d) one or more trusted memories, such as 632, e) a random number generator and f) a plurality of software applications, 610. The other gaming devices, including table gaming device 652, mobile gaming device 654, slot-type gaming device 656 and server 602, can each include a game controller with all or a portion of the components described with respect to game controller 606. Typically, the power-hit tolerant memory is a non-volatile memory of some type.

In particular embodiments, the gaming device can utilize a "state" machine architecture. In a "state" machine architecture critical information in each state is identified and queued for storage to a persistent memory. The architecture doesn't advance to the next state from a current state until all the critical information that is queued for storage for the current state is stored to the persistent memory. Thus, if an error condition occurs between two states, such as a power failure, the gaming device implementing the state machine can likely be restored to its last state prior to the occurrence of the error condition using the critical information associated with its last state stored in the persistent memory. This feature is often called a "roll back" of the gaming device. Examples of critical information can include but are not limited to an outcome determined for a wager-based game, a wager amount made on the wager-based game, an award amount associated with the outcome, credits available on the gaming device and a deposit of credits to the gaming device.

The power-hit tolerant memory 630 can be used as a persistent memory for critical data, such as critical data associated with maintaining a "state" machine on the gaming device. One characteristic of a power-hit tolerant memory 630 is a fast data transfer time. Thus, in the event of a power-failure, which might be indicated by a sudden power fluctuation, the critical data can be quickly loaded from volatile memory, such as RAM associated with the processor 626, into the power-hit tolerant memory 630 and saved.

In one embodiment, the gaming device 605 can be configured to detect power fluctuations and in response, trigger a transfer of critical data from RAM to the power-hit tolerant memory 630. One example of a power-hit tolerant memory 630 is a battery-backed RAM. The battery supplies power to the normally volatile RAM so that in the event of a power failure data is not lost. Thus, a battery-backed RAM is also often referred to as a non-volatile RAM or NV-RAM. An advantage of a battery-backed RAM is that the fast data transfer times associated with a volatile RAM can be obtained.

The trusted memory 632 is typically a read-only memory of some type that may be designed to be unalterable. An EPROM or EEPROM are two types of memory that can be used as a trusted memory 632. The gaming device 604 can include one or more trusted memories. Other types of memories, such as Flash memory, can also be utilized as an unalterable memory and the example of an EPROM or EEPROM is provided for purposes of illustration only.

Prior to installation the contents of a trusted memory, such as 632, can be verified. For instance, a unique identifier, such as a hash value, can be generated on the contents of the memory and then compared to an accepted hash value for the contents of the memory. The memory may not be installed if the generated and accepted hash values do not match. After installation, the gaming device can be configured to check the contents of the trusted memory. For instance, a unique identifier, such as a hash value, can be generated on contents of the trusted memory and compared to an expected value for the unique identifier. If the generated value of the unique identifier and the expected value of the unique identifier don't match, then an error condition can be generated on the gaming device 604. In one embodiment, the error condition can result in the gaming device entering a tilt state where game play is temporarily disabled on the gaming device.

Sometimes verification of software executed on the gaming device 604 can be performed by a regulatory body, such as a government agency. Often software used by a game controller, such as 606, can be highly regulated, where only software approved by a regulatory body is allowed to be executed by the game controller 606. In one embodiment, the trusted memory 632 can store authentication programs and/or authentication data for authenticating the contents of various memories on the gaming device 604. For instance, the trusted memory 632 can store an authentication program that can be used to verify the contents of a mass storage device, such as 620, which can include software executed by the game controller 606.

The random number generator (RNG) 634 can be used to generate random numbers that can be used to determine outcomes for a game of chance played on the gaming device. For instance, for a mechanical or video slot reel type of game, the RNG, in conjunction with a paytable that lists the possible outcomes for a game of chance and the associated awards for each outcome, can be used to generate random numbers for determining reel positions that display the randomly determined outcomes to the wager-based game. In other example, the RNG might be used to randomly select cards for a card game. Typically, as described above, the outcomes generated on a gaming device, such as 604, are considered critical data. Thus, generated outcomes can be stored to the power-hit tolerant memory 630.

Not all gaming devices may be configured to generate their own game outcomes and thus, may not use an RNG for this purpose. In some embodiments, game outcomes can be generated on a remote device, such as server 602, and then transmitted to the gaming device 604 where the outcome and an associated award can be displayed to the player via the player interface 608. For instance, outcomes to a slot-type game or a card game can be generated on server 602 and transmitted to the gaming device 604.

In other embodiments, the gaming device 604 can be used to play central determination games, such as bingo and lottery games. In a central determination game, a pool of game outcomes can be generated and then, particular game outcomes can be selected as needed (e.g., in response to a player requesting to play the central determination game) from the pool of previously generated outcomes. For instance, a pool of game outcomes for a central determination game can be generated and stored on server 602. Next, in response to a request to play the central determination game on gaming device 604, one of the outcomes from the pool can be downloaded to the gaming device 604. A game presentation including the downloaded outcome can be displayed on the gaming device 604.

In other embodiments, thin client type gaming devices, such as mobile gaming devices used to play wager-based video card or video slot games, may be configured to receive at least game outcomes from a remote device and not use an RNG to generate game outcomes locally. The game outcomes can be generated remotely in response to inputs made on the mobile device, such as an input indicating a wager amount and/or an input to initiate the game. This information can be sent from the mobile device to a remote device, such as from mobile gaming device 654 to server 602. After receiving the game outcome from the remote device, a game presentation for the game outcomes generated remotely can be generated and displayed on the mobile device. In some instances, the game presentation can also be generated remotely and then streamed for display to the mobile device.

The game controller 606 can be configured to utilize and execute many different types of software applications 610. Typically, the software applications utilized by the game controller 606 can be highly regulated and may undergo a lengthy approval process before a regulatory body allows the software applications to be utilized on a gaming device deployed in the field, such as in a casino. One type of software application the game controller can utilize is an Operating System (OS). The OS can allow various programs to be loaded for execution by the processor 626, such as programs for implementing a state machine on the gaming device 606. Further, the OS can be used to monitor resource utilization on the gaming device 606. For instance, certain applications, such as applications associated with game outcome generation and game presentation that are executed by the OS can be given higher priority to resources, such as the processor 626 and memory 628, than other applications that can be executing simultaneously on the gaming device.

As previously described, the gaming device 604 can execute software for determining the outcome of a wager-based game and generating a presentation of the determined game outcome including displaying an award for the game. As part of the game outcome presentation one or more of 1) electro-mechanical devices, such as reels or wheels, can be actuated, 2) video content can be output to video displays, 3) sounds can be output to audio devices, 4) haptic responses can be actuated on haptic devices or 5) combinations thereof, can be generated under control of the game controller 606. The peripheral devices used to generate components of the game outcome presentation can be associated with the player interface 608 where the types of devices that are utilized for the player interface 608 can vary from device to device.

To play a game, various inputs can be required. For instance, via input devices coupled to the gaming device 604, a wager amount can be specified, a game can be initiated or a selection of a game choice associated with the play of the game can be made. The software 610 executed by the game controller 606 can be configured to interpret various signals from the input devices, such as signals received from a touch screen controller or input buttons, and affect the game played on the gaming device in accordance with the received input signals. The input devices can also be part of the player interface 608 provided with the gaming device, such as 604.

In other embodiments, the gaming software 610 executed by the game controller 606 can include applications that allow a game history including the results of a number of past games to be stored, such as the previous 10 or 100 games played on the gaming device 604. The game history can be stored to a persistent memory including but not limited to the power-hit tolerant memory 630. The gaming controller 606 can configured to provide a menu (typically, only operator accessible), that allows the results of a past game to be displayed via the player interface 608. The output from the history menu can include a re-creation of the game presentation associated with a past game outcome, such as a video representation of card hand associated with a video poker game, a video representation of a reel configuration associated with a video slot game, and/or raw data associated with the past game result, such as an award amount, an amount wagered, etc. The history menu can be used for dispute resolution purposes, such as if a player complains that they have not been properly awarded for a game previously played on the gaming device 604.

The reporting software can be used by the game controller 606 to report events that have occurred on the gaming device 604 to remote device, such as server 602. For instance, in one embodiment, the game controller 606 can be configured to report error conditions that have been detected on the gaming device 604, such as if a device has malfunctioned or needs attention. For instance, the reporting software can be used to send a message from the gaming device 604 to the server 602 indicating that a printer on the gaming device needs a refill of tickets. In another embodiment, the gaming controller 606 can be configured to report security events that may have occurred on the gaming device 604, such as but not limited to if a door is opened, a latch is activated or an interior portion of the gaming device 604 has been accessed.

In yet other embodiments, the game controller 606 can be configured to report gaming activity and associated events that has been generated on the gaming device, such as a deposit of cash or an indicia of credit, at the gaming device, a generation of game outcome including an associated award amount and a dispensation of cash or an indicia of credit from the gaming device 604. As part of a loyalty program, the gaming activity can be associated with a particular player. The reporting software can include player tracking elements that allow the gaming activity of a particular player to be reported to a remote device, such as server 602.

The game controller 606 can execute the authentication software to verify the authenticity of data and/or software programs executed on the gaming device 604. For instance, the authentication software can be used to verify the authenticity of data and/or software applications when they are first downloaded to the gaming device 604. Further, the authentication software can be used to periodically verify the authenticity of data and/or software applications currently residing on the gaming device, such as software applications stored on one of the memories coupled to the gaming device 604 including applications loaded into the memory 628 for execution by the processor 626.

The communication software executed by the game controller 606 can be used to communicate with a variety of devices remote to the gaming device 604. For instance, the communication software can be used to communicate with one or more of a) servers remote to the device, such as 602, b) other gaming devices, such as table gaming device 652, mobile gaming device 654 and slot-type gaming device 656 and c) mobile devices carried by casino personnel or players in the vicinity of the gaming device 604. Via the communication software, the game controller can be configured to communicate via many different communication protocols. For instance, different wireless and/or wired communication protocols can be implemented. Further, proprietary or non-proprietary gaming specific protocols can be implemented. For instance, gaming specific non-proprietary communication protocols, such as G2S (game to system), GDS (gaming device standard) and S2S (system to system) communication protocols provided by the Gaming Standards Association (GSA), Fremont, Calif., can be implemented on the gaming devices described herein.

The gaming device 604 can communicate with one or more remote devices via one or more network interfaces, such as 612. For instance, via network interfaces 612 and the network 601, the gaming device 604 can communicate with other gaming devices, such as server 602 and/or gaming devices, 652, 654 and 656. The network interfaces can provide wired or wireless communications pathways for the gaming device 604. Some gaming devices may not include a network interface or can be configured to operate in a stand-alone mode where the network interface is not connected to a network.

The gaming device 604 can include one or more each of value input devices 616 and value output device 618. The value input devices 616 can be used to deposit cash or indicia of credit onto the gaming device. The cash or indicia of credit can be used to make wagers on games played on the gaming device 604. Examples of value input devices 616 include but are not limited to a magnetic-striped card or smart card reader, a bill and/or ticket acceptor, a network interface for downloading credits from a remote source, a wireless communication interface for reading credit data from nearby devices and a coin acceptor. A few examples of value input devices are shown in FIG. 8.

The value output devices can be used to dispense cash or indicia of credit from the gaming device 604. Typically, the indicia of credit can be exchanged for cash. For instance, the indicia of credit can be exchanged at a cashier station or at a redemption station. Examples of value output devices can include a network interface for transferring credits into a remote account, a wireless communication interface that can be used with a mobile device implementing mobile wallet application, a coin hopper for dispensing coins or tokens, a bill dispenser, a card writer, a printer for printing tickets or cards redeemable for cash or credits. Another type of value output device is a merchandise dispenser, which can be configured to dispense merchandise with a tangible value from a gaming device. A few examples of value output devices are shown in FIG. 8.

The combination of value input devices 616 and value output devices 618 can vary from device to device. In some embodiments, a gaming device 604 may not include a value input device or a value output device. For instance, a thin-client gaming device used in a mobile gaming application may not include a value input device and a value output device. Instead, a remote account can be used to maintain the credits won or lost from playing wager-based games via the mobile device. The mobile device can be used to access the account and affect the account balance via game play initiated on the mobile device. Credits can be deposited or withdrawn from the remote account via some mechanism other than via the mobile device interface.

In yet other embodiments, the gaming device 604 can include one or more secondary controllers 619. The secondary controllers can be associated with various peripheral devices coupled to the gaming device, such as the value input devices and value output devices described in the preceding paragraphs. As another example, the secondary controllers can be associated with peripheral devices associated with the player interface 608, such as input devices, video displays, electro-mechanical displays and a player tracking unit. In some embodiments, the secondary controllers can receives instructions and/or data from and provide responses to the game controller 606. The secondary controller can be configured to interpret the instructions and/or data from the game controller 606 and control a particular device according to the received instructions and/or data. For instance, a print controller may receive a print command with a number of parameters, such as a credit amount and in response print a ticket redeemable for the credit amount. In another example, a touch screen controller can detect touch inputs and send information to the game controller 606 characterizing the touch input.

In a particular embodiment, a secondary controller can be used to control a number of peripheral devices independently of the game controller 606. For instance, a player tracking unit can include one or more of a video display, a touch screen, card reader, network interface or input buttons. A player tracking controller can control these devices to provide player tracking services and bonusing on the gaming device 604. In alternate embodiments, the game controller 604 can control these devices to perform player tracking functions. An advantage of performing player tracking functions via a secondary controller, such as a player tracking controller, is that since the player tracking functions don't involve controlling the wager-based game, the software on the player tracking unit can be developed modified via a less lengthy and regulatory intensive process than is required for software executed by the game controller 606, which does control the wager-based game. In general, using a secondary controller, certain functions of the gaming device 604 that are not subject to as much regulatory scrutiny as the game play functions can be decoupled from the game controller 606 and implemented on the secondary controller instead. An advantage of this approach, like for the player tracking controller, is that software approval process for the software executed by the secondary controller can be less intensive than the process needed to get software approved for the game controller.

A mass storage unit(s) 620, such as a device including a hard drive, optical disk drive, flash memory or some other memory storage technology can be used to store applications and data used and/or generated by the gaming device 604. For instance, a mass storage unit, such as 620, can be used to store gaming applications executed by the game controller 606 where the gaming device 604 can be configured to receive downloads of game applications from remote devices, such as server 602. In one embodiment, the game controller 606 can include its own dedicated mass storage unit. In another embodiment, critical data, such as game history data stored in the power-hit tolerant memory 630 can be moved from the power-hit tolerant memory 630 to the mass storage unit 620 at periodic intervals for archival purposes and to free up space in the power-hit tolerant memory 630.

The gaming device 604 can include security circuitry 622, such as security sensors and circuitry for monitoring the sensors. The security circuitry 622 can be configured to operate while the gaming device is receiving direct power and operational to provide game play as well as when the gaming device is uncoupled from direct power, such as during shipping or in the event of a power failure. The gaming device 604 can be equipped with one or more secure enclosures, which can include locks for limiting access to the enclosures. One or more sensors can be located within the secure enclosures or coupled to the locks. The sensors can be configured to generate signals that can be used to determine whether secure enclosures have been accessed, locks have been actuated or the gaming device 604, such as a mobile device has been moved to an unauthorized area. The security monitoring circuitry can be configured to generate, store and/or transmit error events when the security events, such as accessing the interior of the gaming device, have occurred. The error events may cause the game controller 606 to place itself in a "safe" mode where no game play is allowed until the error event is cleared.

The server 602 can be configured to provide one or more functions to gaming devices or other servers in a gaming system 600. The server 602 is shown performing a number of different functions. However, in various embodiments, the functions can be divided among multiple servers where each server can communicate with a different combination of gaming devices. For instance, player interface support 636 and gaming device software 638 can be provided on a first server, progressives can be provided on a second server, loyalty program functions 640 and accounting 648 can be provided on a third server, linked gaming 644 can be provided on a fourth server, cashless functions 646 can be provided on a fifth server and security functions 650 can be provided on a sixth server. In this example, each server can communicate with a different combination of gaming devices because each of the functions provided by the servers may not be provided to every gaming device in the gaming system 600. For instance, the server 602 can be configured to provide progressive gaming functions to gaming devices 604, 652 and 656 but not gaming device 654. Thus, the server 602 may not communicate with the mobile gaming device 654 if progressive functions are not enabled on the mobile gaming device at a particular time.

Typically, each server can include an administrator interface that allows the functions of a server, such as 602, to be configured and maintained. Each server 602 can include a processor and memory. In some embodiments, the servers, such as 602, can include a game controller with components, such as but not limited to a power-hit tolerant memory 630, a trusted memory 632 and an RNG 634 described with respect to gaming device 604. The servers can include one or more network interfaces on which wired or wireless communication protocols can be implemented. Next, some possible functions provided by the server 602 are described. These functions are described for the purposes of illustration only and are not meant to be limiting.

The player interface support 636 can be used to serve content to gaming devices, such as 604, 652, 654 and 656, remote to the server. The content can include video and audio content that can be output on one of the player interfaces, such as 608, 652*a*, 654*a* and 656*a*. Further, the content can be configured to utilize unique features of a particular player interface, such as video displays, wheels or reels, if the particular player interface is so equipped.

In one embodiment, via the player interface support, content can be output to all or a portion of a primary video display that is used to output wager-based game outcomes on a player interface associated with a gaming device. For instance, a portion of the primary display can be allocated to providing a "service window" on the primary video display where the content in the service window is provided from a server remote to the gaming device. In particular embodiments, the content delivered from the server to a gaming device as part of the player interface support 636 can be affected by inputs made on the gaming device. For instance, the service window can be generated on a touch screen display where inputs received via the service window can be sent back to server 602. In response, to the received inputs, the server 602 can adjust the content that is displayed on the remote gaming device that generated the inputs.

As described above, a service window application can be allowed to control, send and/or receive data from secondary devices on the EGM, such as a video display, a touch screen power interfaces or communication interfaces. A service window application allowed to utilize a communication interface, such as a wireless communication interface, can be configured to communicate with a portable electronic device via the communication interface.

If a player's identity is known, then the player interface support 636 can be used to provide custom content to a remote gaming device, such as 604. For instance, a player can provide identification information, such as information indicating their membership in a loyalty program, during their utilization of a gaming device. The custom content can be selected to meet the identified player's interests. In one embodiment, the player's identity and interests can be managed via a loyalty program, such as via a loyalty program account associated with loyalty function 640. The custom content can include notifications, advertising and specific offers that are determined to be likely of interest to a particular player.

The gaming device software function 638 can be used to provide downloads of software for the game controller and/or second controllers associated with peripheral devices on a gaming device. For instance, the gaming device software 638 may allow an operator and/or a player to select a new game for play on a gaming device. In response to the game selection, the gaming device software function 638 can be used to download game software that allows a game controller to generate the selected game. In another example, in response to determining that a new counterfeit bill is being accepted by bill acceptors in the gaming system 600, the gaming device software function 638 can be used to download a new detection algorithm to the bill acceptors that allow the counterfeit bill to be detected.

The progressive gaming function 642 can be used to implement progressive game play on one or more gaming devices. In progressive game play, a portion of wagers associated with the play of a progressive game is allocated to a progressive jackpot. A group of gaming devices can be configured to support play of the progressive game and contribute to the progressive jackpot. In various embodiments, the gaming devices contributing to a progressive jackpot may be a group of gaming devices collocated near one another, such as a bank of gaming machines on a casino floor, a group of gaming devices distributed throughout a single casino, or group of gaming devices distributed throughout multiple casinos (e.g., a wide area progressive). The progressive gaming function 642 can be used to receive the jackpot contributions from each of the gaming devices participating in the progressive game, determine a current jackpot and notify participating gaming devices of the current progressive jackpot amount, which can be displayed on the participating gaming devices if desired.

The loyalty function 640 can be used to implement a loyalty program within a casino enterprise. The loyalty function 640 can be used to receive information regarding activities within a casino enterprise including gaming and non-gaming activities and associate the activities with particular individuals. The particular individuals can be known or may be anonymous. The loyalty function 640 can used to store a record of the activities associated with the particular individuals as well as preferences of the individuals if known. Based upon the information stored with the loyalty function 640 comps (e.g., free or discounted services including game play), promotions and custom contents can be served to the particular individuals.

The linked gaming function 644 can be used to used provide game play activities involving player participating as a group via multiple gaming devices. An example, a group of player might be competing against one another as part of a slot tournament. In another example, a group of players might be working together in attempt to win a bonus that can be shared among the players.

The cashless function 646 can enable the redemption and the dispensation of cashless instruments on a gaming device. For instance, via the cashless function, printed tickets, serving as a cashless instrument, can be used to transfer credits from one gaming device to another gaming device. Further, the printed tickets can be redeemed for cash. The cashless function can be used to generate identifying information that can be stored to a cashless instrument, such as a printed ticket, that allows the instrument to later be authenticated. After authentication, the cashless instrument can be used for additional game play or redeemed for cash.

The accounting function can receive transactional information from various gaming devices within the gaming system 600. The transactional information can relate to value deposited on each gaming device and value dispensed from each gaming device. The transactional information, which can be received in real-time, can be used to assess the performance of each gaming device as well as an overall performance of the gaming system. Further, the transactional information can be used for tax and auditing purposes.

The security function 650 can be used to combat fraud and crime in a casino enterprise. The security function 650 can be configured to receive notification of a security event that has occurred on a gaming device, such as an attempt at illegal access. Further, the security function 650 can receive transactional data that can be used to identify if gaming devices are being utilized in a fraudulent or unauthorized manner. The security function 650 can be configured to receive, store and analyze data from multiple sources including detection apparatus located on a gaming device and detection apparatus, such as cameras, distributed throughout a casino. In response to detecting a security event, the security function 650 can be configured to notify casino personnel of the event. For instance, if a security event is detected at a gaming device, a security department can be notified. Depending on the security event, one or more team members of the security department can be dispatched to the vicinity of the gaming device. Next, a perspective diagram of a slot-type gaming device that can include all or a portion of the components described with respect to gaming device 604 is described.

Figure 9:
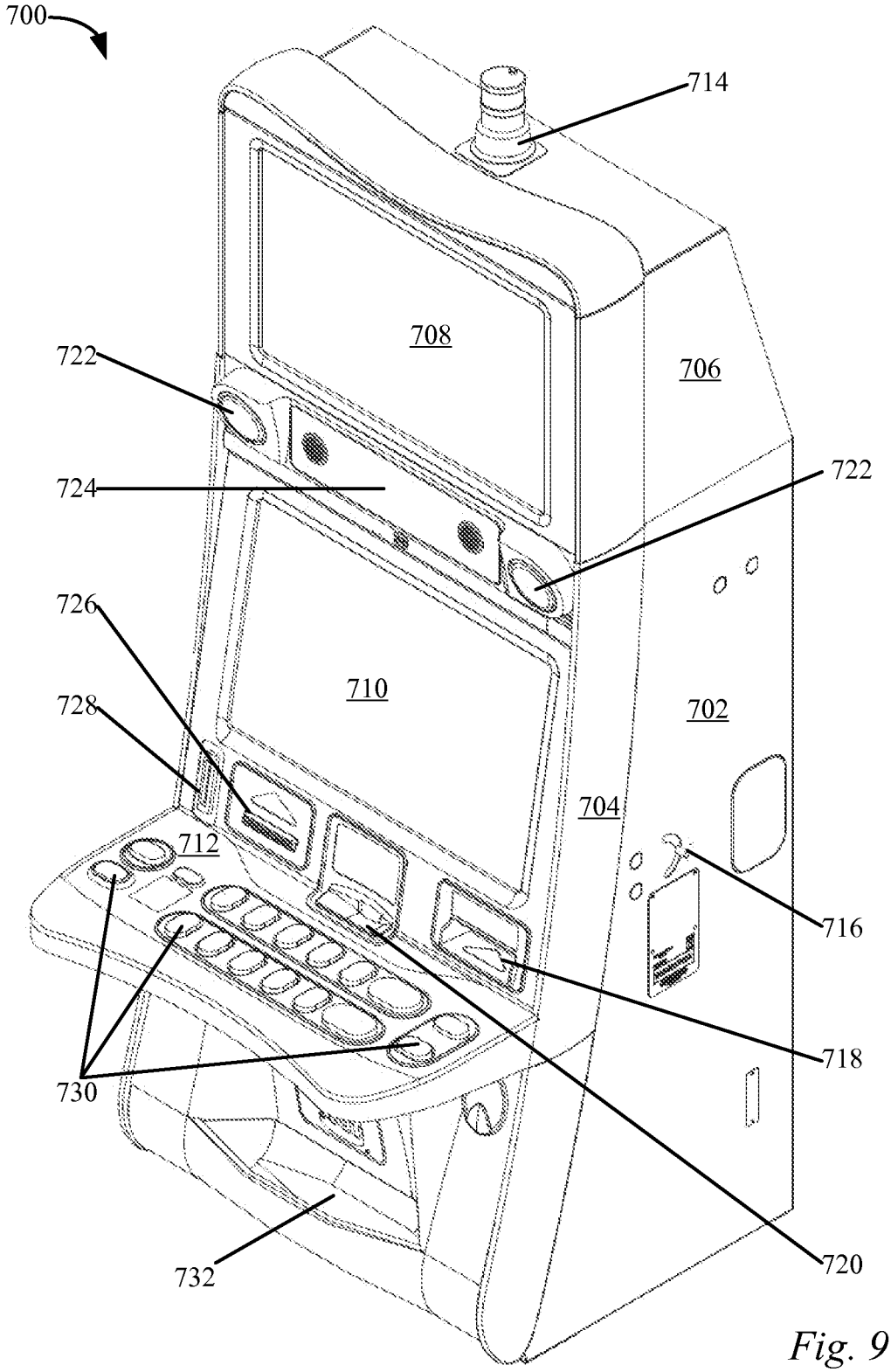
FIG. 9 shows a perspective drawing of a gaming device in accordance with the described embodiments.

FIG. 9 shows a perspective drawing of a gaming device 700 in accordance with the described embodiments. The gaming device 700 is example of what can be considered a "thick-client." Typically, a thick-client is configurable to communicate with one or more remote servers but provides game play, such as game outcome determination, independent of the remote servers. In addition, a thick-client can be considered as such because it includes cash handling capabilities, such as peripheral devices for receiving cash, and a secure enclosure within the device for storing the received cash. In contrast, thin-client device, such as a mobile gaming device, may be more dependent on a remote server to provide a component of the game play on the device, such as game outcome determination, and/or may not include peripheral devices for receiving cash and an associated enclosure for storing it.

Many different configurations are possible between thick and thin clients. For instance, a thick-client device, such as 700, deployed in a central determination configuration, may receive game outcomes from a remote server but still provide cash handling capabilities. Further, the peripheral devices can vary from gaming device to gaming device. For instance, the gaming device 700 can be configured with electro-mechanical reels to display a game outcome instead of a video display, such as 710. Thus, the features of gaming device 700 are described for the purposes of illustration only and are not meant to be limiting.

The gaming device 700 can include a main cabinet 702. The main cabinet 702 can provide a secure enclosure that prevents tampering with the device components, such as a game controller (not shown) located within the interior of the main cabinet and cash handing devices including a coin acceptor 720, a ticket printer 726 and a bill acceptor 718. The main cabinet can include an access mechanism, such as door 704, which allows an interior of the gaming device 700 to be accessed. The actuation of the door 704 can be controlled by a locking mechanism, such as lock 716. The lock 716, the door 704 and the interior of the main cabinet 702 can be monitored with security sensors for detecting whether the interior has been accessed. For instance, a light sensor can be provided to detect a change in light-level in response to the door 704 being opened.

The interior of the main cabinet 700 can include additional secure enclosure, which can also be fitted with locking mechanisms. For instance, the game controller can be secured within a separate locked enclosure. The separate locked enclosure for the game controller may allow maintenance functions to be performed on the gaming device, such as emptying a drop box for coins, emptying a cash box or replacing a device, while preventing tampering with the game controller. Further, in the case of device with a coin acceptor, 720, the separate enclosure can protect the electronics of the game controller from potentially damaging coin dust.

A top box 706 can be mounted to the top of the main cabinet 702. A number of peripheral devices can be coupled to the top box 706. In FIG. 9, a display device 708 and a candle device 714 are mounted to the top box 706. The display device 708 can be used to display information associated with game play on the gaming device 700. For instance, the display device 708 can be used to display a bonus game presentation associated with the play of a wager-based game (One or more bonus games are often features of many wager-based games). In another example, the display device 708 can be used to display information associated with a progressive game, such as one or more progressive jackpot amounts. In yet another example, the display device 708 can be used to display an attract feature that is intended to draw a potential player's attention to the gaming device 700 when it is not in use.

The candle device 714 can include a number of lighting elements. The lighting elements can be lit in different patterns to draw attention to the gaming device. For instance, one lighting pattern may indicate that service is needed at the gaming device 700 while another light pattern may indicate that a player has requested a drink. The candle device 714 is typically placed at the top of gaming device 700 to increase its visibility. Other peripheral devices, including custom bonus devices, such as reels or wheels, can be included in a top box 706 and the example in FIG. 9 is provided for illustrative purposes only. For instance, some of the devices coupled to the main cabinet 702, such as printer 726, can be located in a different top box configuration.

The gaming device 700 provides a player interface that allows the play of a game, such as wager-based game. In this embodiment, the player interface includes 1) a primary video display 710 for outputting video images associated with the game play, 2) audio devices, such as 722, for outputting audio content associated with game play and possibly casino operations, 3) an input panel 712 for at least providing game play related inputs and 4) a secondary video display 708 for outputting video content related to the game play (e.g., bonus material) and/or the casino enterprise (e.g., advertising). In particular embodiments, one or both of the video displays, 708 and 710, can be equipped with a touch screen sensor and associated touch screen controller, for detecting touch inputs, such as touch inputs associated with the play of a game or a service window output to the display device.

The input panel 712 can include a number of electro-mechanical input buttons, such as 730, and/or touch sensitive surfaces. For instance, the input panel can include a touch screen equipped video display to provide a touch sensitive surface. In some embodiments, the functions of the electro-mechanical input buttons can be dynamically reconfigurable. For instance, the function of the electro-mechanical input buttons may be changed depending on the game that is being played on the gaming device. To indicate function changes, the input buttons can each include a configurable display, such as an e-ink or a video display for indicating the function of button. The output of the configurable display can be adjusted to account for a change in the function of the button.

The gaming device 700 includes a card reader 728, a printer 726, a coin acceptor 720, a bill and/or ticket acceptor 720 and a coin hopper (not shown) for dispensing coins to a coin tray 732. These devices can provide value input/output capabilities on the gaming device 700. For instance, the printer 726 can be used to print out tickets redeemable for cash or additional game play. The tickets generated by printer 726 as well as printers on other gaming devices can be inserted into bill and ticket acceptor 718 to possibly add credits to the gaming device 700. After the ticket is authenticated, credits associated with the ticket can be transferred to the gaming device 700.

The device 718 can also be used to accept cash bills. After the cash bill is authenticated, it can be converted to credits on the gaming device and used for wager-based game play. The coin acceptor 720 can be configured to accept coins that are legal tender or tokens, such as tokens issued by a casino enterprise. A coin hopper (not shown) can be used to dispense coins that are legal tender or tokens into the coin tray 732.

The various aspects, embodiments, implementations or features of the described embodiments can be used separately or in any combination. Various aspects of the described embodiments can be implemented by software, hardware or a combination of hardware and software. The computer readable medium is any data storage device that can store data which can thereafter be read by a computer system. Examples of the computer readable medium include read-only memory, random-access memory, optical media (e.g., CD-ROMs, DVDs), magnetic tape, solid state drives (e.g., flash drives) and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. It will be apparent to one of ordinary skill in the art that many modifications and variations are possible in view of the above teachings.

The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

While the embodiments have been described in terms of several particular embodiments, there are alterations, permutations, and equivalents, which fall within the scope of these general concepts. It should also be noted that there are many alternative ways of implementing the methods and apparatuses of the present embodiments. It is therefore intended that the following appended claims be interpreted as including all such alterations, permutations, and equivalents as fall within the true spirit and scope of the described embodiments.

What is claimed is:

1. An electronic gaming machine comprising:

a video display;

a plurality of mechanical slot reels;

a light guide positioned between the video display and the plurality of mechanical slot reels, the light guide including a continuous substrate having edges which define the boundary of a rectangular viewing area, the viewing area having a first window portion and a second window portion, the plurality of mechanical slot reels positioned behind the first window portion;

a first light source positioned along one of the edges of the light guide for supplying light in a first direction through the continuous substrate;

a second light source positioned along another one of the edges of the light guide for supplying light in a second direction through the continuous substrate, the second direction being perpendicular to the first direction;

first features in the first window portion oriented to extract light traveling parallel to the first direction while substantially rejecting light travelling parallel to the second direction, the extracted light having a uniform brightness over an area of the first window portion; and second features in the second window portion oriented to extract light travelling parallel to the second direction, the extracted light having a uniform brightness over an area of the second window portion.

2. The electronic gaming machine of claim 1, wherein the continuous substrate of the light guide comprises acrylic.

3. The electronic gaming machine of claim 1, wherein the first light source can be turned on in order to obscure the plurality of mechanical slot reels.

4. The electronic gaming machine of claim 1, wherein a first portion of the video display positioned in front of the first window portion and a second portion of the video display positioned in front of the second window portion are operable to display a single continuous image when both the first light source and the second light source are supplying light.

5. The electronic gaming machine of claim 1, wherein the first light source is a LED light bar.

6. The electronic gaming machine of claim 1, wherein a density of the first features increases as a distance from the first light source increases.

7. A method of making an electronic gaming machine for a wager-based game, the method comprising:

providing a video display;

providing a plurality of mechanical slot reels;

positioning a light guide between the video display and the plurality of mechanical slot reels, wherein the light guide comprises a continuous substrate having a viewing area, the viewing area having a first window portion and a second window portion, wherein the viewing area includes first features having a first orientation positioned over the first window portion, wherein the viewing area includes second features having a second orientation positioned over the second window portion, the plurality of mechanical reels are positioned behind the first window portion;

positioning a first light source along a first edge of the light guide for supplying light through the continuous substrate in a first direction, wherein the first features in the first window portion are oriented to uniformly extract light over an area of the first window portion that is travelling parallel to the first direction, wherein the first window portion is substantially transparent when the first light source is off regardless of whether the second light source is on or off; and positioning a second light source along a second edge of the light guide for supplying light through the continuous substrate in a second direction, the second direction being perpendicular to the first direction, wherein the second features in the second window portion are oriented to uniformly extract light over an area of the second window portion that is travelling parallel to the second direction wherein the second window portion is substantially transparent when the second light source is off, and wherein the first features substantially reject light travelling in the second direction.

8. A method of operating an electronic gaming machine for a wager-based game, the electronic gaming machine including a video display positioned proximally of a light guide, the light guide positioned proximally of a display element, the light guide having perpendicular first and second edges, first and second light sources positioned along the first and second edges, respectively, such, that light from the first light source travels through the light guide in a first direction, and light from the second light source travels through the light guide in a second direction, perpendicular to the first direction, the light guide having a viewing area that includes a window portion surrounded by a surrounding portion, the window portion and the surrounding portion each having features which respectively extract light traveling parallel to the first and second directions, the features within the window portion substantially rejecting light travelling parallel to the second direction, the method comprising:

turning the first light source on to obscure the display element and uniformly backlight a portion of the video display adjacent to the window portion; and turning the second light source on to uniformly backlight a portion of the video display adjacent to the surrounding portion.

9. The method of claim 8, further comprising:

displaying a single continuous image on portions of the video display that are adjacent to both the window portion and the surrounding portion when the first light source and the second light source are both turned on.

10. The method of claim 8, further comprising:

turning off the first light source to reveal the display element, wherein the display element is a rotatable reel; and spinning the rotatable reel in response to a wager to provide an outcome.

11. The method of claim 8, further comprising turning on the first light source to obscure the display element and providing video content in the portion of the video display adjacent to the window portion.

12. The electronic gaming machine of claim 1, wherein the first features are first etchings and the second features are second etchings, wherein the first etchings are oriented perpendicular to the second etchings.

13. The electronic gaming machine of claim 1, wherein the second window portion surrounds the first window portion.

14. The electronic gaming machine of claim 1, wherein the second features are oriented so as to not extract light travelling parallel to the first direction.

15. The electronic gaming machine of claim 1, wherein the first features and the second features span the entire viewing area.

16. The electronic gaming machine of claim 15, wherein light from the first light source is directed through at least part of both the first window portion and the second window portion of the continuous substrate, and light from the second light source is directed through at least part of both the first window portion and the second window portion of the continuous substrate.

17. The electronic gaming machine of claim 1, wherein when the first light source is not supplying light and the second light source is supplying light: (i) the first window portion is transparent, (ii) the second window portion is opaque, and (iii) extracted light from the second window portion backlights portions of the video display adjacent to the second window portion.

18. The electronic gaming machine of claim 17, wherein when both the first light source and the second light source are supplying light the first window portion and the second window portion are both opaque, and extracted light from the first window portion and from the second window portion backlight portions of the video display adjacent to the first window portion and the second window portion, respectively.

* * * * *

UNITED STATES PATENT AND TRADEMARK OFFICE

CERTIFICATE OF CORRECTION

PATENT NO. : 9,082,256 B2
APPLICATION NO. : 13/449168
DATED : July 14, 2015
INVENTOR(S) : Chauncey W. Griswold et al.

It is certified that error appears in the above-identified patent and that said Letters Patent is hereby corrected as shown below:

IN THE CLAIMS

In Claim 1, Column 20, Line 19, replace “the” with --a--.
In Claim 7, Column 21, Line 22, delete “and”.

Signed and Sealed this
Ninth Day of February, 2016

Michelle K. Lee

Michelle K. Lee
*Director of the United States Patent and Trademark Office*